US011608143B2

(12) United States Patent
Grimaldi

(10) Patent No.: US 11,608,143 B2
(45) Date of Patent: Mar. 21, 2023

(54) MOVABLE PLATFORM ASSEMBLY WITH TRANSLATION SYSTEM

(71) Applicant: OPACMARE S.R.L., Turin (IT)

(72) Inventor: Michele Grimaldi, Piossasco (IT)

(73) Assignee: OPACMARE S.R.L., Turin (IT)

( * ) Notice: Subject to any disclaimer, the term of this patent is extended or adjusted under 35 U.S.C. 154(b) by 178 days.

(21) Appl. No.: 17/227,478

(22) Filed: Apr. 12, 2021

(65) Prior Publication Data

US 2021/0316823 A1 Oct. 14, 2021

(30) Foreign Application Priority Data

Apr. 14, 2020 (IT) ..... 102020000007795

(51) Int. Cl.
*B63B 27/14* (2006.01)

(52) U.S. Cl.
CPC ..... *B63B 27/14* (2013.01)

(58) Field of Classification Search
CPC ..... B63B 27/14; B63B 2027/141; B63B 2029/022; B63B 27/146
See application file for complete search history.

(56) References Cited

U.S. PATENT DOCUMENTS

| | | | | |
|---|---|---|---|---|
| 6,457,508 | B1 | 10/2002 | Tomita | |
| 9,586,655 | B1 | 3/2017 | Butler | |
| 9,796,456 | B1 * | 10/2017 | Zarn | A47B 88/43 |
| 9,957,016 | B2 | 5/2018 | Grimaldi et al. | |
| 10,124,864 | B1 * | 11/2018 | Zarn | A47B 88/40 |
| 2010/0212576 | A1 | 8/2010 | Muller | |

OTHER PUBLICATIONS

Search Report for IT 2020000007795 dated Aug. 14, 2020.
Written Opinion for IT 2020000007795 dated Aug. 14, 2020.

* cited by examiner

*Primary Examiner* — Anthony D Wiest
(74) *Attorney, Agent, or Firm* — Ferguson Case Orr Paterson

(57) ABSTRACT

A movable platform assembly for a boat includes a support structure configured to be connected to the boat, a platform, and a horizontal translation system connecting the platform to the support structure, the horizontal translation system having a pair of main arms rotatable about respective vertical rotation axes, and a pair of main sliders sliding in a transverse direction along a main guide integral with the platform. Each main arm has a proximal end hinged to the support structure and a distal end hinged to a respective main slider. The platform is translatable between a retracted position and an extended position with respect to the support structure.

10 Claims, 8 Drawing Sheets

MOVABLE PLATFORM ASSEMBLY WITH TRANSLATION SYSTEM

CROSS REFERENCE TO RELATED APPLICATION

This application claims priority to and benefit of Italian Patent Application No. 102020000007795 to OPACMARE S.R.L., filed on Apr. 14, 2020, which is fully incorporated by reference herein in its entirety.

FIELD OF THE INVENTION

The present invention relates in general to platform assemblies for boats which provide movable support surfaces for objects or people. Such assemblies may be used, for example, for hauling and launching tenders or other marine vehicles equipping boats, or for transit or temporary presence of people.

BACKGROUND OF THE INVENTION

Telescopic gangways are known, comprising a movable part which moves translationally in a guided manner with respect to a fixed part. In such telescopic systems, even in the position of maximum extension of the movable part, it is necessary to have a significant overlap between the movable part and the fixed part in order for the parts to interlock, which ensures stability in the structure. Generally, there is a translation/size ratio of approximately 3/4; in other words, in the position of maximum extension, about a quarter of the length of the movable part remains superimposed on the fixed part. This means that the available surface of the gangway in extended position is significantly less than the sum of the surfaces of the fixed part and the movable part; the difference in length, therefore, leads to a certain amount of space that may not be used.

If this is acceptable for gangways, in which the length extension is generally significantly greater than the width of the structures involved, it is not desirable for platforms, in which the length extension may be approximately equal or even less than the width extension of the structures.

SUMMARY OF THE INVENTION

An object of the present invention, therefore, is to provide a translation system which allows greater use of surfaces.

Accordingly, the movable platform assembly for a boat according to the present invention, comprises

- a support structure configured to be connected to the boat,
- a platform, and
- a horizontal translation system that connects the platform to the support structure, said translation system comprising a pair of main arms rotatable about respective vertical rotation axes, and a pair of main sliders slidable in a transverse direction along a main guide fixed to the platform, wherein each main arm comprises a proximal end hinged to the support structure and a distal end hinged to one of the main sliders, and wherein the platform is movable translationally between a retracted position and an extended position with respect to the support structure.

Due to the rotating arm movement, it is possible to design platform assemblies in which the translation/size ratio of the platform is close to 1. In other words, the platform may be moved translationally for an extension almost equal to its length. This allows a greater use of the surfaces with respect to known systems.

Furthermore, since the overlap between the parts when the platform is in an extended position is reduced, if the horizontal movement is combined with other movements, the risks of mutual interference are reduced; therefore, the assembly according to the present invention may be equipped in a relatively simple way with further movements, such as those conventionally used to lower or raise the platform, allowing increasing versatility of the entire assembly.

Preferred embodiments of the present invention are also described.

Further features and advantages of the assembly according to the present invention will become evident from the following detailed description, made with reference to the appended drawings, provided purely by way of non-limiting example.

DETAILED DESCRIPTION

Figure 1A:
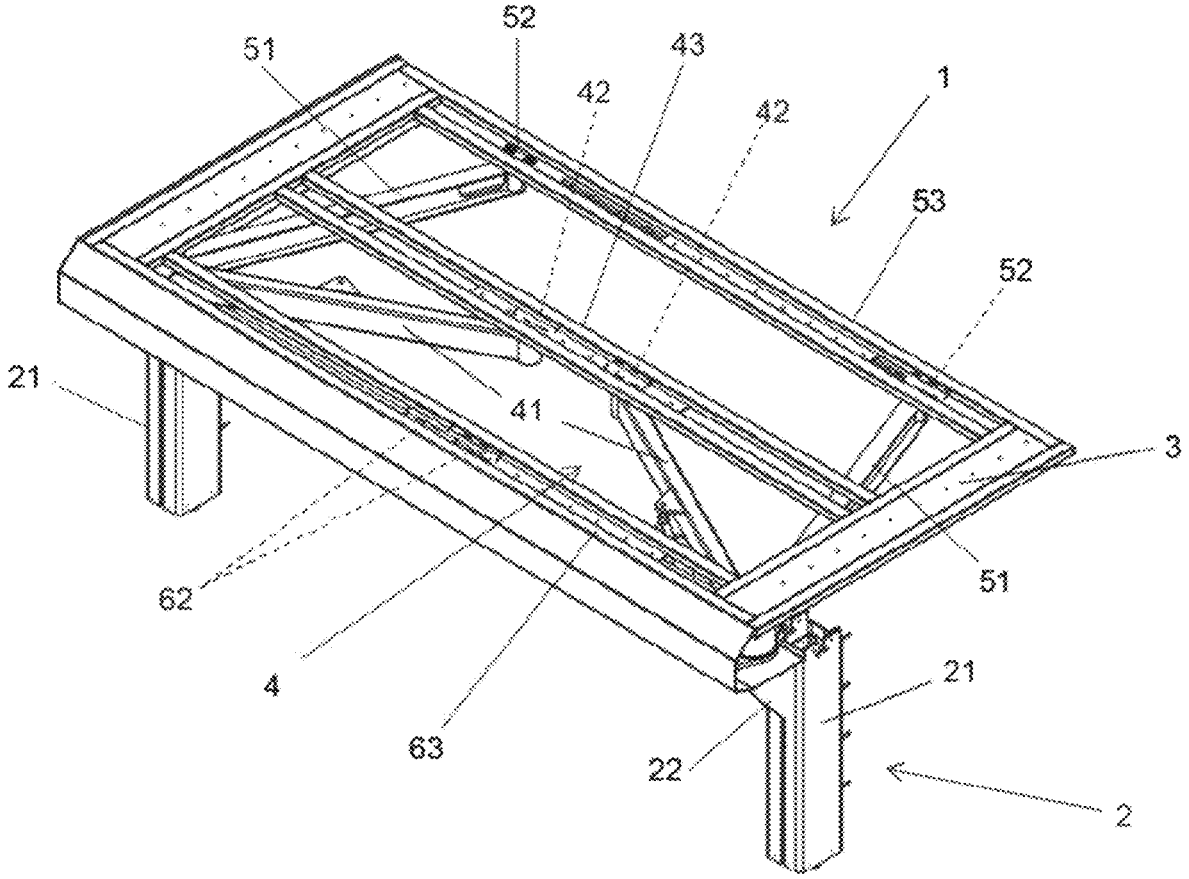
FIGS. 1*a* and 1*b* are perspective views of a platform assembly according to the present invention, in two different operating positions.
Figure 1B:
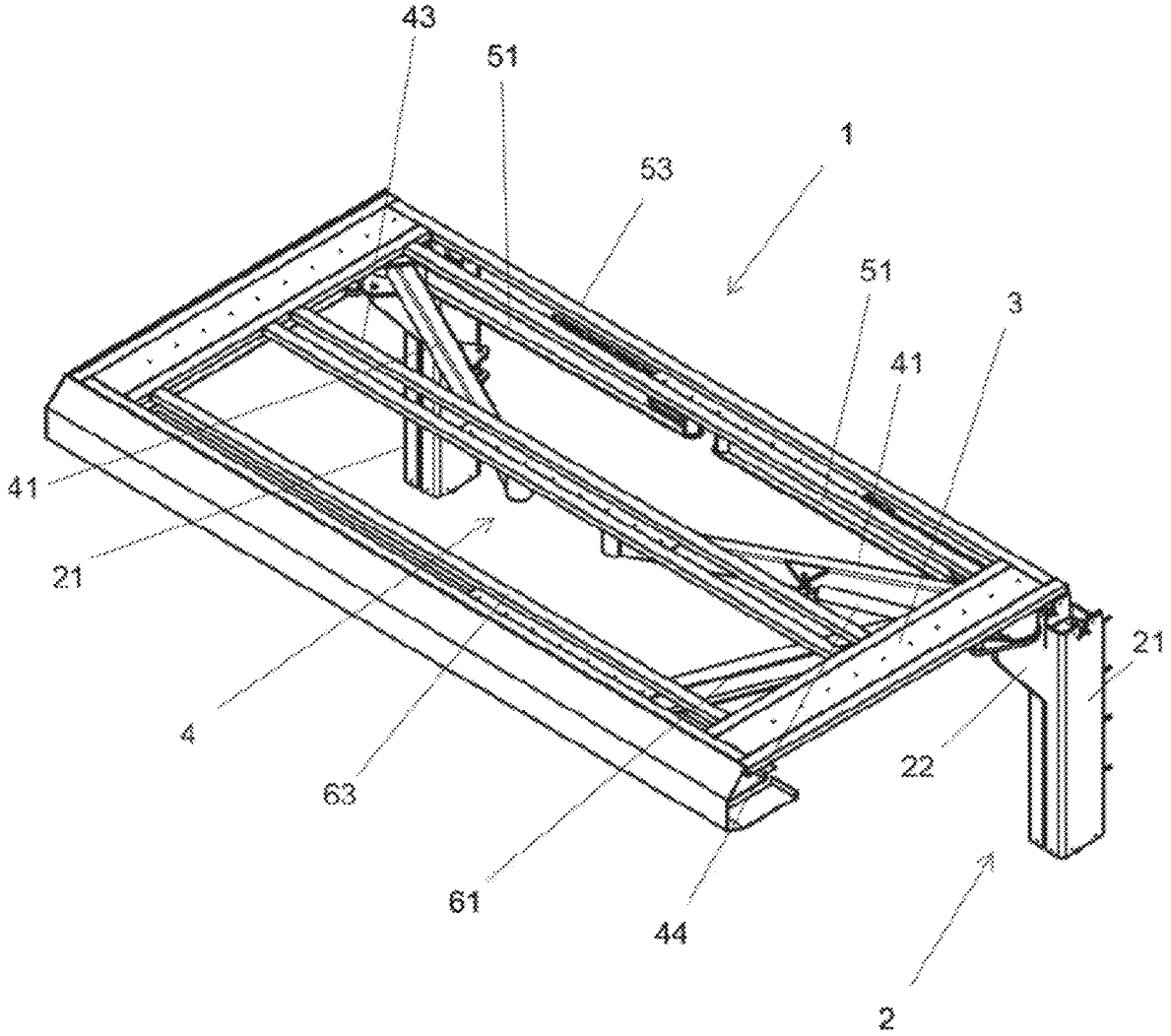

FIGS. 1*a-b* show a platform assembly 1 configured to be installed on a boat, according to the present invention. More generally, the present invention may relate to different platform assemblies, installed on a fixed structure or on a vehicle.

Figure 2:
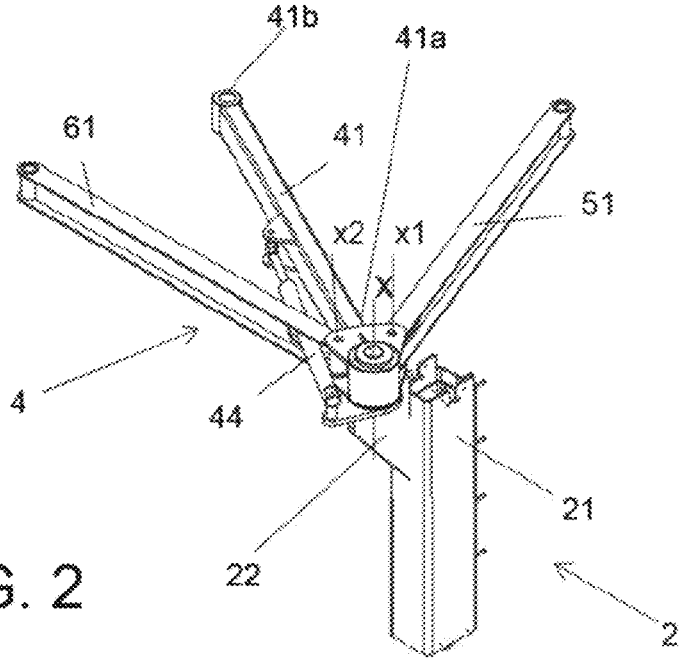
FIG. 2 is a perspective view of a part of a translation system of the assembly of FIGS. 1*a-b;*

The platform assembly 1 comprises a support structure 2 configured to be connected to the boat B, a translationally movable platform 3, and a horizontal translation system 4 connecting the platform 3 to the support structure 2. The platform 3 supports a walking surface, omitted in FIG. 1, to show the underlying parts. In the illustrated example, the support structure 2 comprises two separate halves. Alternatively, the support structure may comprise further elements connecting the halves together. In the embodiment of FIGS. 1-3, the support structure 2 is stationary, i.e., in use it is fixed to the boat. In alternative embodiments, which will be described hereinafter, the support structure 2 may be connected to the boat by movement systems; therefore, it may be movable with respect to the boat.

The platform assembly 1 is substantially symmetrical with respect to a central longitudinal plane. For convenience, FIG. 2 shows only one half of the support structure 2 and the horizontal translation system 4. In the following description, the term "longitudinal" refers to a direction parallel to the direction of translation of the platform 3, while the term "transverse" refers to a direction orthogonal to the longitudinal direction. The term "vertical" refers to a direction orthogonal to both the longitudinal direction and the transverse direction.

The support structure 2 comprises a pair of uprights 21 and a pair of supports 22 vertically slidable in a guided way along the respective uprights 21. Linear actuators (not shown) are also provided, for example hydraulic cylinders, to control the movement of the supports 22 along the uprights 21. According to an alternative embodiment, the supports 22 are fixed to the uprights 21.

The supports 22 project longitudinally from the uprights 21, and provide support for the translation system 4.

The translation system 4 comprises a pair of main arms 41 rotatable about respective vertical rotation axes x arranged on the supports 22, and a pair of main sliders 42 sliding in transverse direction along a main guide 43 integral with the platform 3. The main sliders 42 are hidden in the figures and represented by dashed lines. The main guide 43 may comprise a single guide, or two separate respective guides for each of the main sliders 42.

Each main arm 41 comprises a proximal end 41*a* hinged to the support structure 2, more precisely to the respective support 22, and a distal end 41*b* hinged to a respective main slider 42. The two vertical rotation axes x of the main arms 41 are arranged at a fixed distance from each other, smaller than or equal to the width of the platform 3. Associated with each of the main arms 41 there is a linear actuator 44, for example a hydraulic cylinder, which rotates the respective main arm 41 by means of a lever arm. Alternatively, for the control of each of the main arms 41 it is possible to provide a respective rotary actuator arranged directly on the vertical rotation axis x of the main arm 41. The main arms 41 are turned toward each other and are mirror-wise rotatable in the opposite direction with respect to each other, whereby the place of the intersection points of their virtual extensions in the different angular positions that they may reach is comprised of a central segment extending in the longitudinal direction.

By virtue of the arrangement described above, the simultaneous rotation of the two main arms 41 causes the platform 3 to move translationally in a longitudinal direction, between a retracted position and an extended position with respect to the support structure 2, respectively represented in FIGS. 1*a* and 1*b*. The longitudinal translation direction is represented by arrows in FIGS. 3*a-c*, 4*a-b*, 5*a-b* and 8*a-b*.

In the assembly shown there are two pairs of secondary arms 51 and 61. Each of the arms of each pair rotates with respect to a fixed vertical axis x1, x2, parallel to the vertical rotation axis x, and is connected to the platform 3 by a slider 52, 62 translating in a transverse guide 53, 63 fixed to the platform 3. The function of the two pairs of arms is to make the platform 3 stable. The secondary arms 51 and 61 are not essential and may be absent.

In the assembly described above, the translation stroke of the platform 3 substantially corresponds to the length of the overall dimensions of the platform in the boat. To appreciate this aspect, reference may be made to FIGS. 3*a-d*, showing the assembly installed on board a boat B. In particular, the assembly is installed in a stern area, but it may be used to build side platforms protruding from the sides of the boat.

Figure 3A:
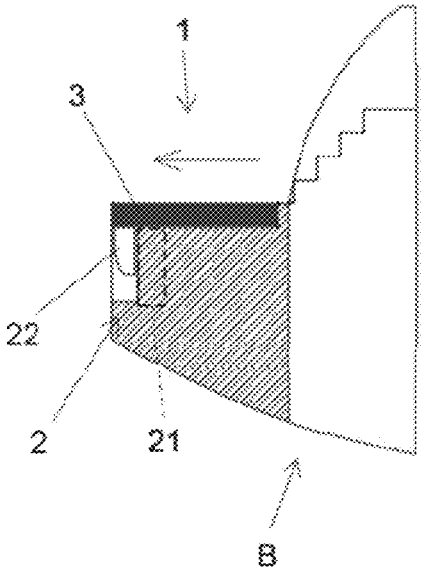
FIGS. 3*a-d* are side elevation views of the assembly of FIGS. 1*a-b*, in different operating positions.
Figure 3B:
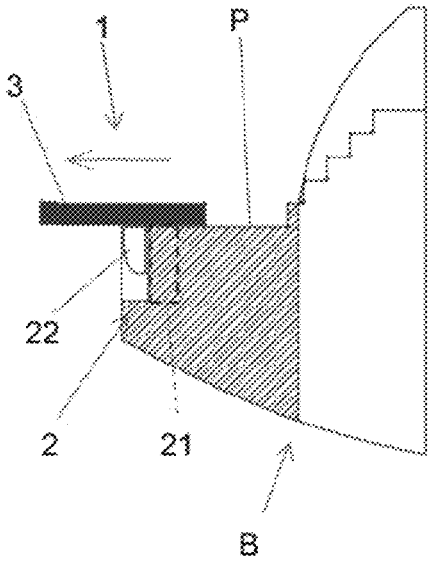
Figure 3C:
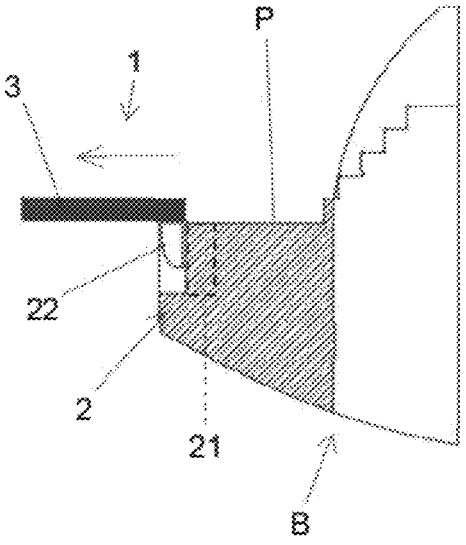
Figure 3D:
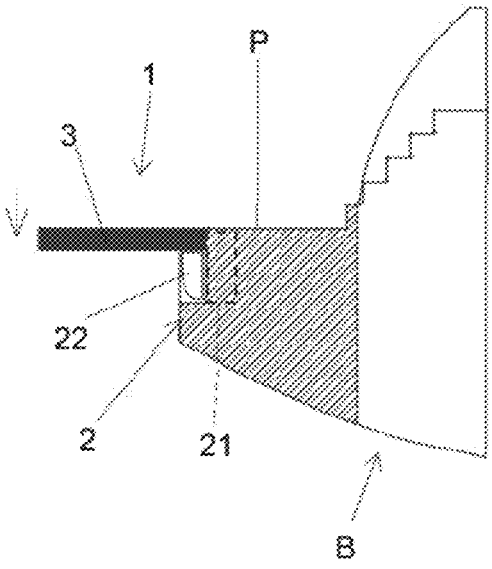

The installation area of the assembly 1 on board the boat B is shown by an area filled in with diagonal hatching. As may be appreciated, the support structure 2 is arranged at the periphery of the installation area, and therefore of the boat, while the platform 3 in the retracted position is entirely (or almost) inside the boat. When the platform 3 is brought to the position of maximum advancement (FIG. 3*c*), the underlying part of the installation area is completely (or almost completely) exposed to the outside. Therefore, a large walkable surface is created between the installation area of the assembly 1 and the platform 3. Advantageously, as shown in FIG. 3*d*, it is possible to align the platform 3 with a walking surface P of the boat to have a single continuous surface, by lowering the supports 22.

Figure 4A:
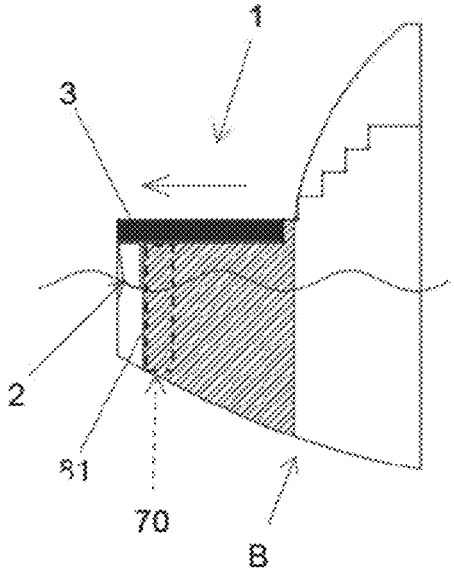
FIGS. 4*a-c* are side elevation views of the assembly of FIGS. 1*a-b* combined with a vertical translation system, in different operating positions.
Figure 4B:
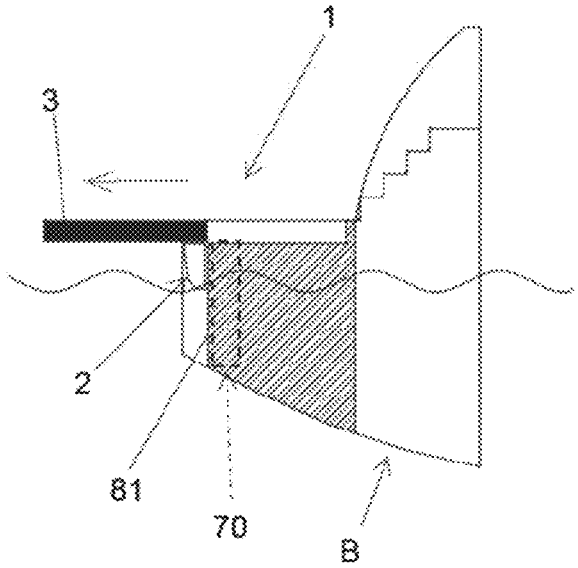
Figure 4C:
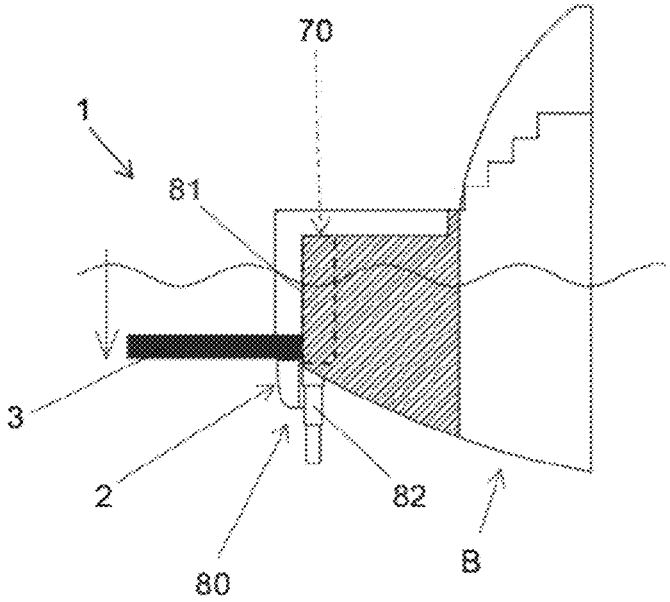

FIGS. 4*a-c* show an embodiment in which the assembly described above is combined with a vertical translation system. In this case the assembly comprises a base structure 70 configured to be fixed to the boat B, and a vertical translation system 80, which connects the support structure 2 of the assembly 1 to the base structure 70. The vertical translation system may comprise guides 81 fixed to the base structure 70, along which the support structure 2 of the assembly 1 is arranged to slide, and linear actuators 82, such as hydraulic cylinders, to control the translation of the support structure 2 in the vertical direction with the platform 3 in the extended position. The support structure 2 may comprise only the supports 22 described above, which are slidably mounted directly on the base structure 70.

The embodiment shown in FIGS. 4*a-c* may be used as a device for hauling and launching tenders and similar vehicles, or as a submersible dock for swimming even on a boat where the platform is not protruding or in the case it is desired to use the space under the platform to expand the stern area of the hull.

FIGS. 5*a-c* and 6*a-b* show an embodiment in which the platform assembly described above is combined with an articulated parallelogram movement system.

Such embodiment comprises a base structure 90 configured to be fixed to the boat, and an articulated parallelogram movement system 100, which connects the support structure 2, in particular the uprights 21, to the base structure 90. The movement system 100 is conventionally formed of a plurality of rods hinged together so as to provide an articulated parallelogram mechanism, which allows the support structure 2 to move with the platform 3, relative to the base structure 90, among a plurality of different positions, keeping the orientation of the support structure 2 constant with the platform 3, in particular a horizontal orientation. An actuator (not shown) is also associated with the movement system 100, by virtue of which the support structure 2 with the platform 3 may be moved.

A plurality of steps 101 is articulated to the movement system 100, which, due to the articulated parallelogram mechanism of the system, are also capable of maintaining a constant orientation, in particular a horizontal orientation, during movement of the platform 3.

Figure 5A:
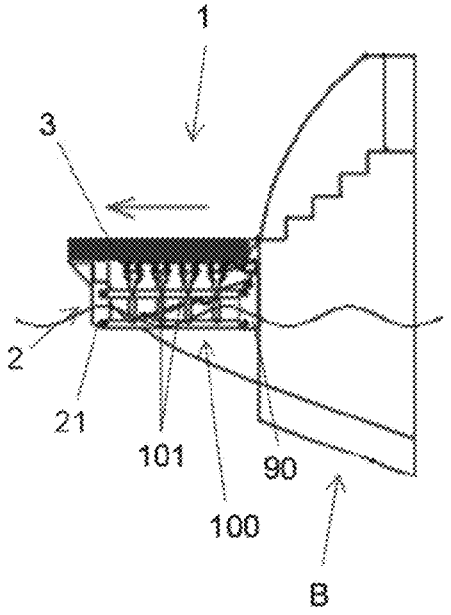
FIGS. 5*a-c* and 6*a-b* are side elevation views of the assembly of FIGS. 1*a-b* combined with an articulated parallelogram movement system, in different operating positions.
Figure 5B:
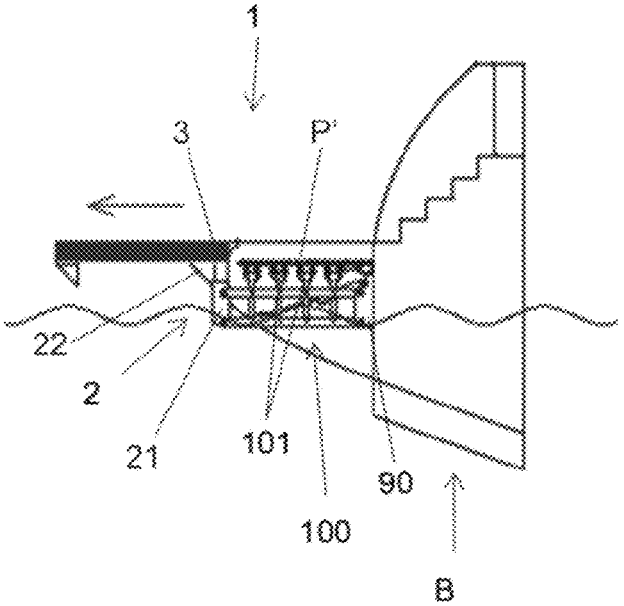
Figure 5C:
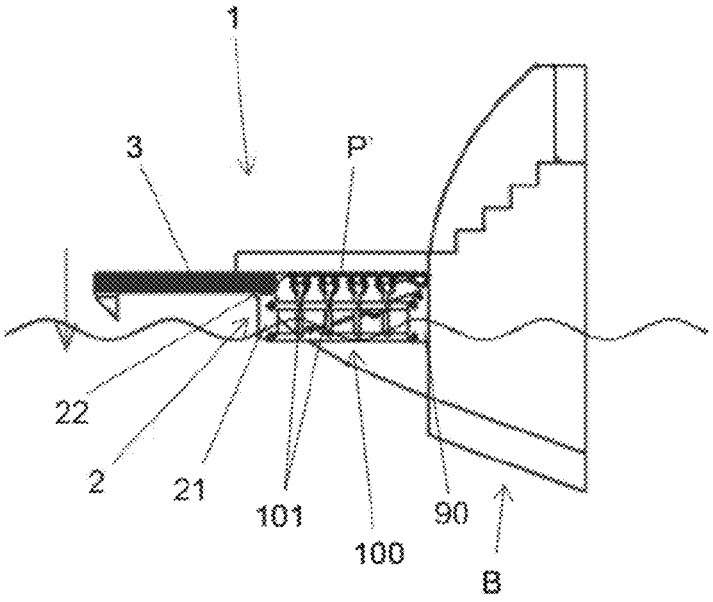

In the assembly of FIGS. 5*a-c* and 6*a-b* a rest position of the articulated parallelogram movement system 100 may be seen, in which the movement system 100 is oriented horizontally (FIGS. 5*a-c*). It should be observed that in the rest position of the articulated parallelogram system 100 the steps 101 are arranged at the same height and cooperate to define a walking surface P'. With the movement system in the rest position, the platform may be brought from its retracted position (FIG. 5*a*) to its maximum extended position (FIG. 5*b*). From this position, the platform 3 is lowered to align itself with the walking surface P' defined by the steps 101, making use of the vertical translation system interposed between the uprights 21 and the supports 22 of the support structure 2 (FIG. 5*c*).

Figure 6A:
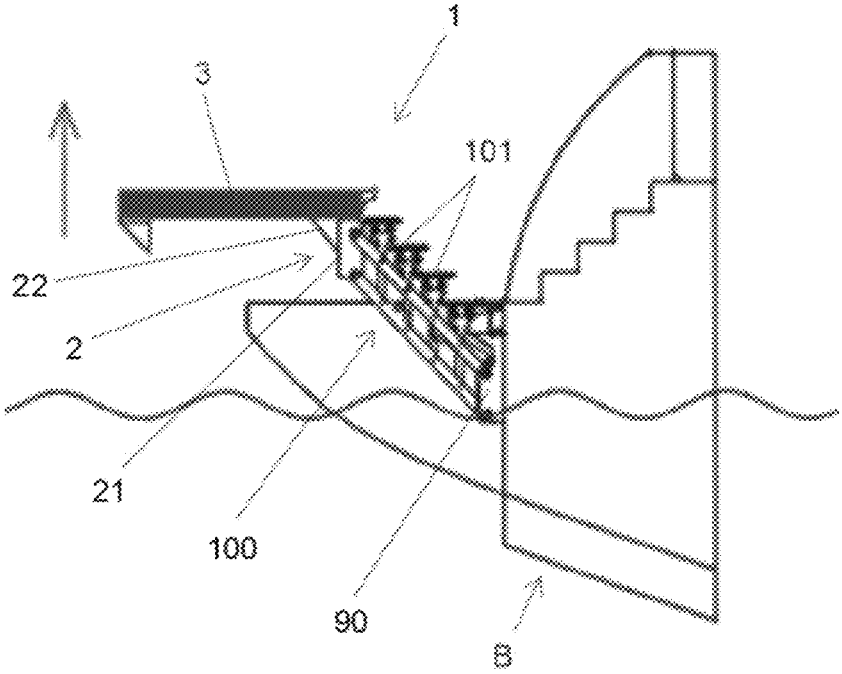
Figure 6B:
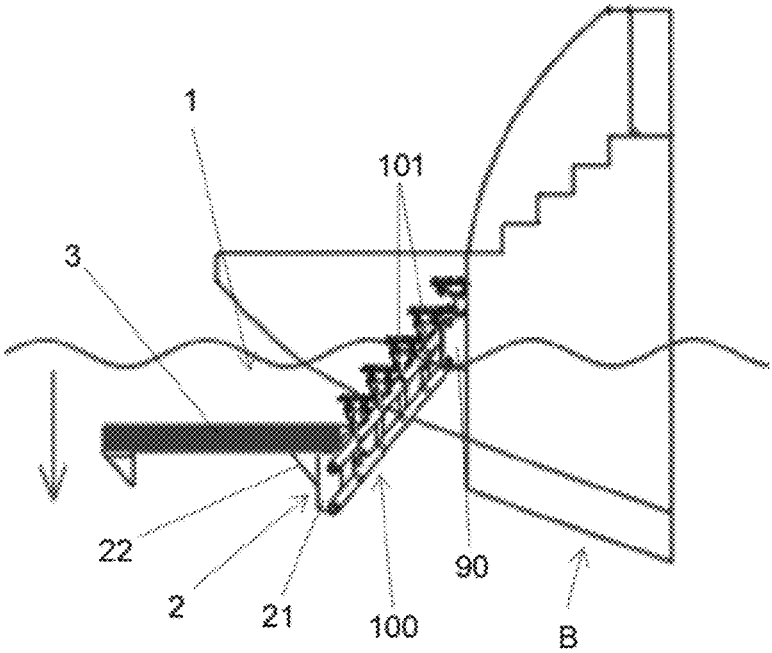

From this position the support structure 2 with the platform 3 in the extended position is movable toward a plurality of second positions in which the articulated quadrilateral system 100 is inclined. Two of these positions are shown in FIGS. 6*a* and 6*b*. In FIG. 6*a* the movement system 100 is inclined upward and, consequently, the support structure 2 with the platform 3 is raised with respect to the rest position. In FIG. 6*b* the movement system 100 is inclined downward and, consequently, the support structure 2 with the platform 3 is lowered with respect to the rest position.

In the embodiment of FIGS. 5*a-c* and 6*a-b* it is possible to have a submersible platform with a convenient ladder for descending into the water or landing on a quay, while reducing the size of the platform on the boat and limiting protrusion of the platform in navigation conditions.

Figure 7:
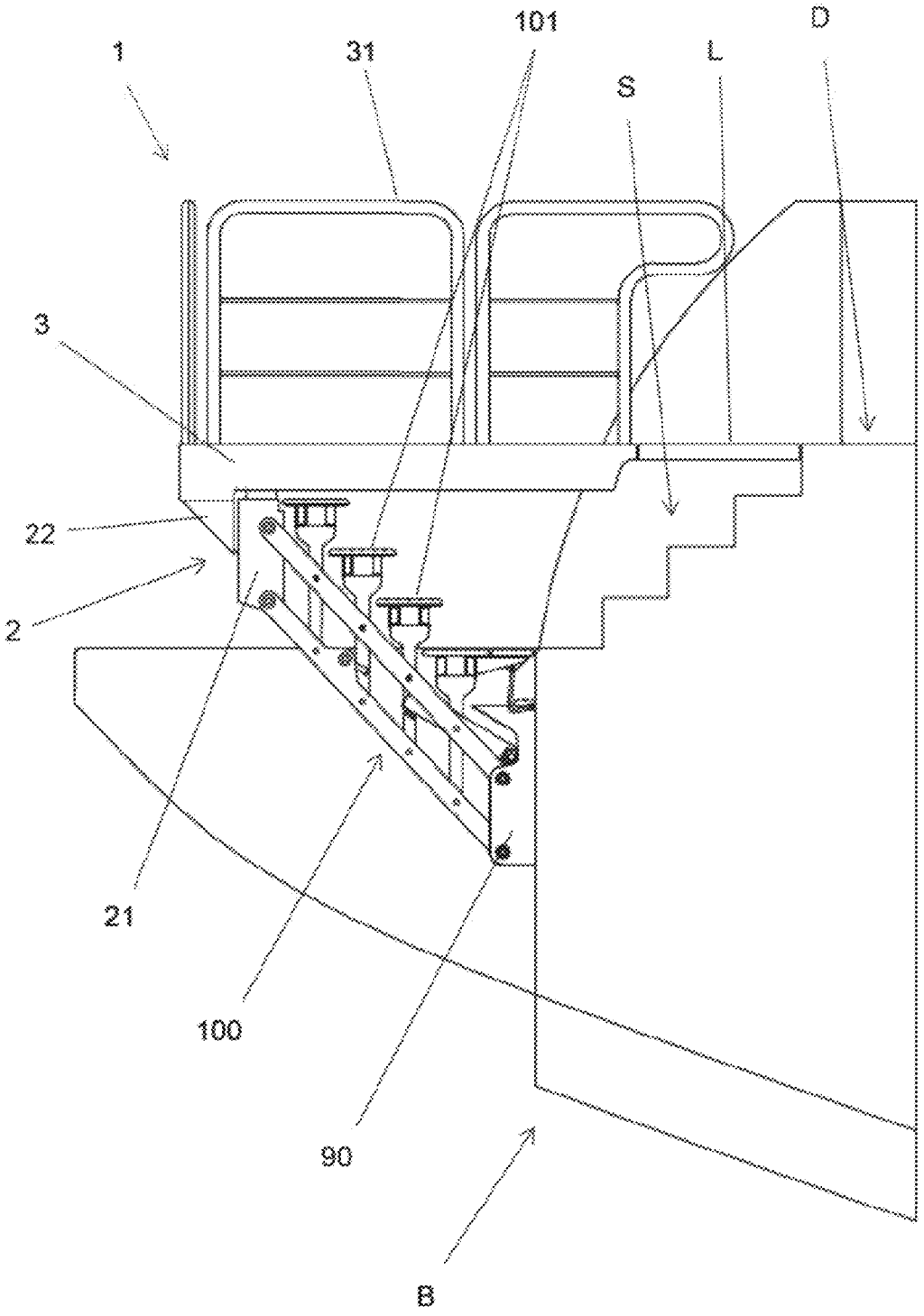
FIG. 7 represents a variant of the configuration of FIGS. 5*a-c* and 6*a-b*.

FIG. 7 shows a variant of the embodiment of FIGS. 5*a-c* and 6*a-b*. Reference D indicates a deck of the boat, located at a higher level than the installation area of the platform assembly 1. The platform 3 is equipped with a railing 31, which may be fixed, in a removable manner, on the platform 3, or may provide a deployment mechanism for switching the railing 31 between a lowered configuration and a raised configuration. Reference L indicates a landing that is extractable from the deck D or from the stairs S that connect the deck D to the installation area of the platform assembly 1.

In the variant of FIG. 7 it is possible to bring the platform 3 to the height of the boat's deck D and, due to the extractable landing L, create an extension of the deck to increase its space.

Figure 8A:
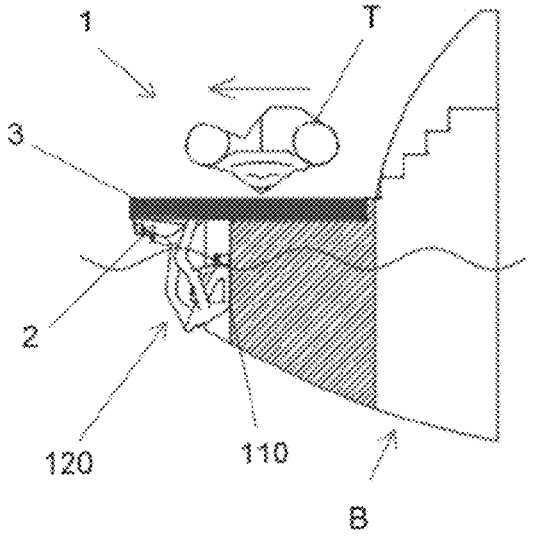
FIGS. 8*a-c* are side elevation views of the assembly according to the present invention combined with an articulated quadrilateral movement system, in different operating positions.
Figure 8B:
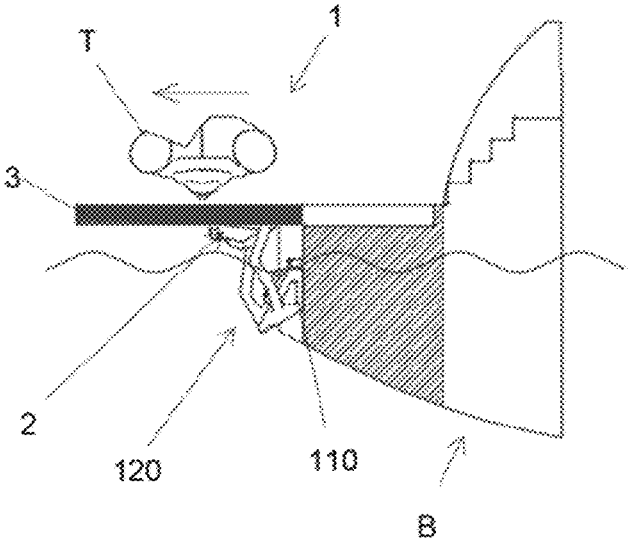
Figure 8C:
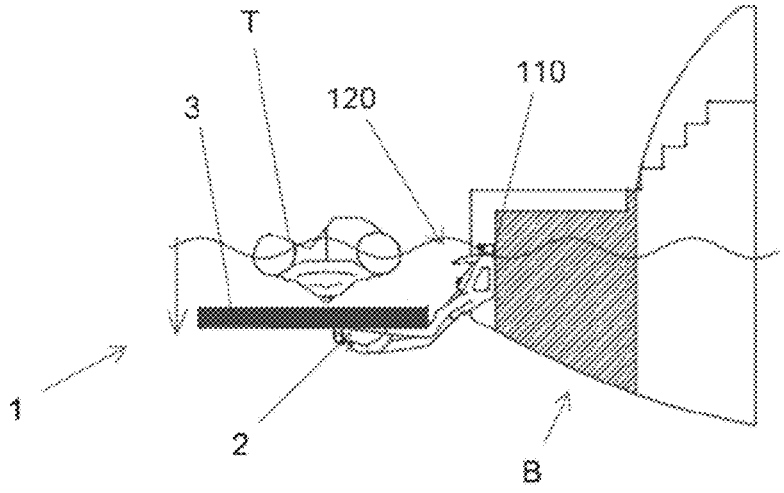

FIG. 8*a-c* show an embodiment in which the platform assembly described above is combined with an articulated quadrilateral movement system.

This embodiment comprises a base structure 110 configured to be fixed to the boat, and an articulated quadrilateral movement system 120 which connects the support structure 2 to the base structure 110. The movement system 120 is conventionally formed of a plurality of rods or levers hinged together so as to provide an articulated quadrilateral mechanism, which allows the support structure 2 to be moved with the platform 3, relative to the base structure 110, among a plurality of different positions, keeping the orientation of the support structure 2 constant with the platform 3, in particular a horizontal orientation. An actuator (not shown) is further associated with the movement system 120, by virtue of which the support structure 2 with the platform 3 may be commanded to move.

In particular, the assembly of FIGS. 8*a-c* is movable between a rest position, represented in FIG. 8*a*, and a lowered position represented in FIG. 8*c*. FIG. 8*b* shows the platform in an extended position. Although not represented in the figures, also the assembly of FIGS. 8*a-c* may be provided with a vertical translation movement to align the platform 3 in an advanced position with a walking surface of the boat. Even in this case, the advantage of the present invention is evident due to the favorable position of the tender T in navigation and the possibility of launching the tender without having to manually move it from its position.

It is to be understood that application aspects, details or components described only in relation to some embodiments are also applicable, where compatible, to the other embodiments described.

What is claimed is:

1. A movable platform assembly for a boat, comprising:
a support structure configured to be connected to the boat,
a platform, and
a horizontal translation system connecting the platform to the support structure, said horizontal translation system comprising a pair of main arms rotatable about respective vertical rotation axes (x), and a pair of main sliders slidable in transverse direction along a main guide fixed to the platform, wherein each main arm comprises a proximal end hinged to the support structure and a distal end hinged to a respective main slider, and wherein the platform is translationally movable between a retracted position and an extended position relative to the support structure.

2. The movable platform assembly of claim 1, wherein said vertical rotation axes are arranged at a fixed distance from each other, said distance being smaller than or equal to a width of the platform, and wherein said main arms are mirror-wise rotatable in opposite directions relative to each other.

3. The movable platform assembly of claim 1, wherein the horizontal translation system further comprises at least one pair of secondary arms rotating about respective secondary rotation axes (x1, x2) parallel to the vertical rotation axes (x) and respectively hinged to secondary sliders slidable in transverse direction along a secondary guide fixed to the platform and parallel to the main guide.

4. The movable platform assembly of claim 1, wherein the support structure comprises at least one upright and at least one support that carries the horizontal translation system and is vertically slidable in a guided manner along the at least one upright, wherein the platform in the extended position is translationally movable in vertical direction between a raised position and a lowered position, the platform being alignable in the lowered position with a walking surface of the boat.

5. The movable platform assembly of claim 1, further comprising:
a base structure configured to be fixed to the boat, and
a vertical translation system connecting the support structure to the base structure, wherein the support structure with the platform in the extended position is translationally movable in vertical direction between a raised position and a lowered position.

6. The movable platform assembly of claim 1, further comprising:
a base structure configured to be fixed to the boat, and
an articulated quadrilateral or parallelogram movement system connecting the support structure to the base structure.

7. The movable platform assembly of claim 6, wherein the movement system is an articulated parallelogram movement system, and wherein the support structure with the platform in the extended position is movable between a first position, in which the articulated parallelogram movement system is horizontally oriented, and a plurality of second positions, in which the articulated parallelogram movement system is tilted.

8. The movable platform assembly of claim 7, wherein a plurality of steps is articulated to the articulated parallelogram movement system, and wherein in said first position the steps of said plurality of steps are arranged at a same height and cooperate to define a walking surface.

9. The movable platform assembly of claim 8, wherein the support structure comprises at least one upright and at least one support that carries the horizontal translation system and is vertically slidable in a guided manner along the at least one upright, wherein the platform in the extended position is translationally movable in vertical direction between a raised position and a lowered position, and wherein in said lowered position the platform is aligned with the walking surface defined by the steps.

10. The movable platform assembly of claim 7, wherein in one of said second positions the platform is alignable with a deck of the boat positioned at a greater height than said base structure.

* * * * *